US009055853B2

(12) United States Patent
Rosenzweig et al.

(10) Patent No.: US 9,055,853 B2
(45) Date of Patent: Jun. 16, 2015

(54) STEAM APPLIANCE

(71) Applicant: Euro-Pro Operating LLC, Newton, MA (US)

(72) Inventors: Maximilian Rosenzweig, Montreal (CA); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 0 days.

(21) Appl. No.: 14/081,455

(22) Filed: Nov. 15, 2013

(65) Prior Publication Data

US 2014/0130291 A1 May 15, 2014

Related U.S. Application Data

(63) Continuation of application No. 13/465,784, filed on May 7, 2012, now Pat. No. 8,613,151, which is a continuation of application No. 12/541,652, filed on Aug. 14, 2009, now Pat. No. 8,365,447.

(60) Provisional application No. 61/105,979, filed on Oct. 16, 2008, provisional application No. 61/105,564, filed on Oct. 15, 2008.

(51) Int. Cl.

| | |
|---|---|
| ***D06F 75/30*** | (2006.01) |
| ***A47L 11/34*** | (2006.01) |
| ***D06F 75/20*** | (2006.01) |

(Continued)

(52) U.S. Cl.

CPC ..... *A47L 11/34* (2013.01); *D06F 75/20* (2013.01); *D06F 75/30* (2013.01); *D06F 75/34* (2013.01); *A47L 11/4075* (2013.01)

(58) Field of Classification Search

CPC ..... D06F 75/30; D06F 75/34; D06F 75/38
USPC ..... 38/74–95
See application file for complete search history.

(56) References Cited

U.S. PATENT DOCUMENTS

| | | | |
|---|---|---|---|
| 1,394,662 | A | 10/1921 | Blomquist |
| 1,578,178 | A | 3/1926 | Scoles |
| 1,629,738 | A | 5/1927 | Rohne |

(Continued)

FOREIGN PATENT DOCUMENTS

| | | | |
|---|---|---|---|
| EP | 315915 | A * | 5/1989 |
| EP | 1 801 281 | A1 | 6/2007 |

(Continued)

OTHER PUBLICATIONS

International Search Report and Written Opinion for PCT/US2009/064401 mailed Apr. 21, 2010.

(Continued)

*Primary Examiner* — Ismael Izaguirre
(74) *Attorney, Agent, or Firm* — Wolf, Greenfield & Sacks, P.C.

(57) ABSTRACT

A steam appliance having a split handle with the upper part biased away from the handle base and an actuator for a water pump. When the appliance is pushed, the handle upper part is depressed and displaces a pump actuator to activate the pump. Use of a steam frame and steam towel allows an iron to be used as a steam cleaner. When a pole is mounted on the upper handle part, the appliance may be used as a steam mop that is activated by pushing the pole which depresses the handle to actuate the pump.

6 Claims, 7 Drawing Sheets

(51) Int. Cl.
*A47L 11/40* (2006.01)
*D06F 75/34* (2006.01)

(56) References Cited

U.S. PATENT DOCUMENTS

| | | | | |
|---|---|---|---|---|
| 1,641,037 | A | | 8/1927 | Kirschenbaum |
| 1,774,409 | A | | 8/1930 | Tripp |
| 1,831,463 | A | | 11/1931 | Nobbs |
| 1,927,227 | A | | 9/1933 | Woods |
| 1,969,036 | A | | 8/1934 | Riebel, Jr. |
| 2,051,058 | A | | 8/1936 | Replogle |
| 2,072,217 | A | * | 3/1937 | Reed ..... 38/79 |
| 2,674,054 | A | | 4/1954 | Maykemper |
| 2,700,236 | A | * | 1/1955 | Marvin et al. ..... 38/77.83 |
| 2,749,633 | A | | 6/1956 | Seck |
| 2,750,695 | A | | 6/1956 | Swenson |
| 2,810,149 | A | | 10/1957 | Guelker |
| 2,865,037 | A | | 12/1958 | King |
| 3,050,885 | A | | 8/1962 | Whitfield |
| 3,072,941 | A | | 1/1963 | McMaster |
| 3,074,192 | A | | 1/1963 | Smith |
| 3,121,965 | A | | 2/1964 | McBride |
| 3,234,672 | A | * | 2/1966 | Foster ..... 38/30 |
| 3,286,368 | A | | 11/1966 | Thomas |
| 3,623,909 | A | | 11/1971 | Jones |
| 3,711,891 | A | | 1/1973 | Conway |
| 3,986,282 | A | | 10/1976 | Nelson |
| 4,312,598 | A | | 1/1982 | Vagner |
| 4,577,424 | A | | 3/1986 | Liu |
| 4,660,307 | A | | 4/1987 | Fay |
| 4,688,025 | A | | 8/1987 | Frank |
| 4,837,952 | A | | 6/1989 | Hennuy et al. |
| 4,968,166 | A | | 11/1990 | Ingram |
| 5,016,313 | A | | 5/1991 | Yonehara |
| 5,121,464 | A | | 6/1992 | Hanada et al. |
| 5,309,593 | A | | 5/1994 | Yonehara |
| 5,512,728 | A | | 4/1996 | Jalbert |
| 5,751,074 | A | | 5/1998 | Prior et al. |
| 5,966,851 | A | | 10/1999 | Serpa |
| 6,249,996 | B1 | | 6/2001 | Dorber et al. |
| 6,298,518 | B1 | | 10/2001 | Umbrell |
| 6,453,587 | B1 | | 9/2002 | Alipour |
| 6,499,519 | B1 | | 12/2002 | Brown |
| 6,513,269 | B2 | | 2/2003 | Kobayashi et al. |
| 6,584,990 | B2 | | 7/2003 | Shaw |
| 6,644,877 | B1 | | 11/2003 | Chen |
| 6,674,028 | B1 | | 1/2004 | Berton |
| 6,733,199 | B2 | | 5/2004 | Dingert et al. |
| 6,925,738 | B2 | | 8/2005 | Alipour |
| 7,562,474 | B2 | | 7/2009 | Voitchovsky |
| 7,930,798 | B2 | | 4/2011 | Zhou et al. |
| 7,996,949 | B2 | | 8/2011 | Rosenzweig et al. |
| 8,056,272 | B2 | | 11/2011 | Rosenzweig et al. |
| 8,240,002 | B2 | | 8/2012 | Haan |
| 8,365,447 | B2 | | 2/2013 | Rosenzweig et al. |
| 8,402,597 | B2 | | 3/2013 | Rosenzweig et al. |
| 8,522,463 | B2 | * | 9/2013 | Ong et al. ..... 38/77.9 |
| 8,613,151 | B2 | | 12/2013 | Rosenzweig et al. |
| 2002/0020085 | A1 | | 2/2002 | Kobayashi et al. |
| 2002/0194693 | A1 | | 12/2002 | Wu |
| 2004/0040579 | A1 | | 3/2004 | Smith |
| 2005/0017681 | A1 | | 1/2005 | Ogishima et al. |
| 2005/0278987 | A1 | | 12/2005 | Ching et al. |
| 2007/0231046 | A1 | | 10/2007 | Whiffen et al. |
| 2008/0066789 | A1 | | 3/2008 | Rosenzweig et al. |
| 2008/0168688 | A1 | | 7/2008 | Hahn |
| 2008/0236635 | A1 | | 10/2008 | Rosenzweig et al. |
| 2009/0000051 | A1 | | 1/2009 | Rosenzweig et al. |
| 2009/0178697 | A1 | | 7/2009 | Rosenzweig et al. |
| 2009/0223540 | A1 | | 9/2009 | Rosenzweig et al. |
| 2009/0279938 | A1 | | 11/2009 | Rosenzweig et al. |
| 2010/0024146 | A1 | | 2/2010 | Rosenzweig et al. |
| 2010/0037495 | A1 | | 2/2010 | Rosenzweig et al. |
| 2010/0040489 | A1 | | 2/2010 | Rosenzweig et al. |
| 2010/0058624 | A1 | | 3/2010 | Voitchovsky |
| 2010/0088932 | A1 | | 4/2010 | Rosenzweig et al. |
| 2010/0116298 | A1 | | 5/2010 | Rosenzweig et al. |
| 2010/0126535 | A1 | | 5/2010 | Rosenzweig et al. |
| 2010/0236018 | A1 | | 9/2010 | Vrdoljak et al. |
| 2011/0107528 | A1 | | 5/2011 | Haan |
| 2011/0107533 | A1 | | 5/2011 | Haan |
| 2011/0150438 | A1 | | 6/2011 | Cho et al. |
| 2013/0061414 | A1 | | 3/2013 | Swist et al. |

FOREIGN PATENT DOCUMENTS

| | | | |
|---|---|---|---|
| FR | 2289146 | A1 | 5/1976 |
| GB | 750504 | A | 6/1956 |
| GB | 2225930 | A | 6/1990 |
| JP | 2006-255148 | A | 9/2006 |
| JP | 07-313115 | A | 12/2007 |
| KR | 20-0247949 | Y1 | 10/2001 |
| KR | 20-0280969 | Y1 | 7/2002 |
| KR | 20-0280970 | Y1 | 7/2002 |
| WO | WO 86/00511 | A1 | 1/1986 |
| WO | WO 98/49385 | A1 | 11/1998 |
| WO | WO 01/55496 | A2 | 8/2001 |
| WO | WO 02/00088 | A2 | 1/2002 |
| WO | WO 2006/008461 | A1 | 1/2006 |
| WO | WO 2008/016741 | A2 | 2/2008 |
| WO | WO 2008/016761 | A2 | 2/2008 |
| WO | WO 2008/056122 | A2 | 5/2008 |
| WO | WO 2008/078867 | A1 | 7/2008 |

OTHER PUBLICATIONS

International Search Report and Written Opinion for PCT/US2009/060834 mailed Jan. 21, 2010.

International Preliminary Report on Patentability for PCT/US2009/060834 mailed Apr. 28, 2011.

International Search Report and Written Opinion for PCT/US2009/053803 mailed Jan. 15, 2010.

* cited by examiner

STEAM APPLIANCE

RELATED APPLICATIONS

This application claims the benefit under 35 U.S.C. §120 of, and is a continuation of, U.S. application Ser. No. 13/465,784, entitled "STEAM APPLIANCE" filed on May 7, 2012, now published as U.S. Patent Application Publication No. 2012/0216841, which is herein incorporated by reference in its entirety. U.S. application Ser. No. 13/465,784 claims the benefit under 35 U.S.C. §120 of, and is a continuation of, U.S. application Ser. No. 12/541,652, entitled "CONVERTIBLE STEAM APPLIANCE" filed on Aug. 14, 2009, now U.S. Pat. No. 8,365,447, which is herein incorporated by reference in its entirety. U.S. application Ser. No. 12/541,652 claims priority under 35 U.S.C. §119(e) to U.S. Provisional Application Ser. No. 61/105,564, entitled "CONVERTIBLE STEAM APPLIANCE" filed on Oct. 15, 2008, which is herein incorporated by reference in its entirety. U.S. application Ser. No. 12/541,652 also claims priority under 35 U.S.C. §119(e) to U.S. Provisional Application Ser. No. 61/105,979, entitled "CONVERTIBLE STEAM APPLIANCE" filed on Oct. 16, 2008, which is herein incorporated by reference in its entirety.

BACKGROUND OF THE INVENTION

The invention relates generally to a steam generating appliance, and more particularly to a steam generating appliance that can be used as a steam iron and converts to a steam brush for steaming floors and fabrics that is user actuated by the movement of the appliance to pump water from a reservoir to a boiler for generating steam.

Conventional steam generating appliances typically provide a dedicated function and specific use. For example, a steam iron is used to iron fabrics, steam mops are used for cleaning floors and steam brushes are used for fabrics and clothing, furniture and drapes to clean and remove wrinkles.

Recent steam appliances, such as steam mops have been developed wherein water is pumped from a reservoir to a boiler by the push-pull movement of the device. This movement actuates a pump operatively connected to the appliance handle. Examples are shown and described in application Ser. No. 11/496,143 (published as U.S. Application Publication No. 2008/0236635) and Ser. No. 11/769,521, (published as U.S. Application Publication No. 2008/0066789) the contents of which are incorporated herein by reference in their entirety. Conventional steam irons and fabric steaming devices are well known.

Notwithstanding the wide variety of steam products available, it remains desirable to provide a steam appliance having improved ways to use the appliance while pumping water from the reservoir to the steam boiler to generate steam.

SUMMARY OF THE INVENTION

Generally speaking, in accordance with the invention, a steam appliance having multiple uses based on addition of various attachments is provided. The basic appliance may be a steam iron or hand held steamer that easily converts to a steam brush or cleaner upon addition of a steam frame and steam pad, towel or steam pocket to the steam iron sole plate. By using an appliance having a heated metal base or a steam iron as the basic appliance, the fabric of the pad or towel is heated by the metal plate so that the fabric is disinfected and dries during use and between uses. Connection of a pole to the handle readily converts the unit to a steam mop.

The steam appliance handle has a push down feature for water delivery. The appliance includes a handle fixed to the appliance housing with a displaceable member to contact an actuator to actuate a water pump. When a user moves the appliance the pump actuator is depressed to actuate pumping water to the steam generator.

A towel frame having at least one steam opening allowing for passing steam therethrough is secured over the metal base and a towel is secured to the frame. This converts an iron to a steam brush or cleaner that can be used in the horizontal, vertical or at any other angle. A pole connector is mounted to or operatively connected to the a moveable element on the housing for receiving a pole or extension handle to allow use of the steam cleaner as a steam mop. This facilitates cleaning of hard to reach areas. The connector may be attached by a first pin through a hinge-type opening that will allow up and down pivoting of the pole. The connector may also include a hinge at 90° to the first pin to allow for side to side pivoting and provide a true universal connection. By pushing the pole to move the steam appliance the actuator is depressed to activate the pump to pump water to the steam generator.

Accordingly, it is an object of the invention to provide an improved steam appliance.

Another object of the invention is to provide an improved steam appliance that may easily be converted from a steam iron to a steam brush or cleaner or a steam mop.

A further object of the invention is to provide an improved steam appliance wherein movement of an actuator on the appliance housing activates a pump to pump water to the steam generator.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
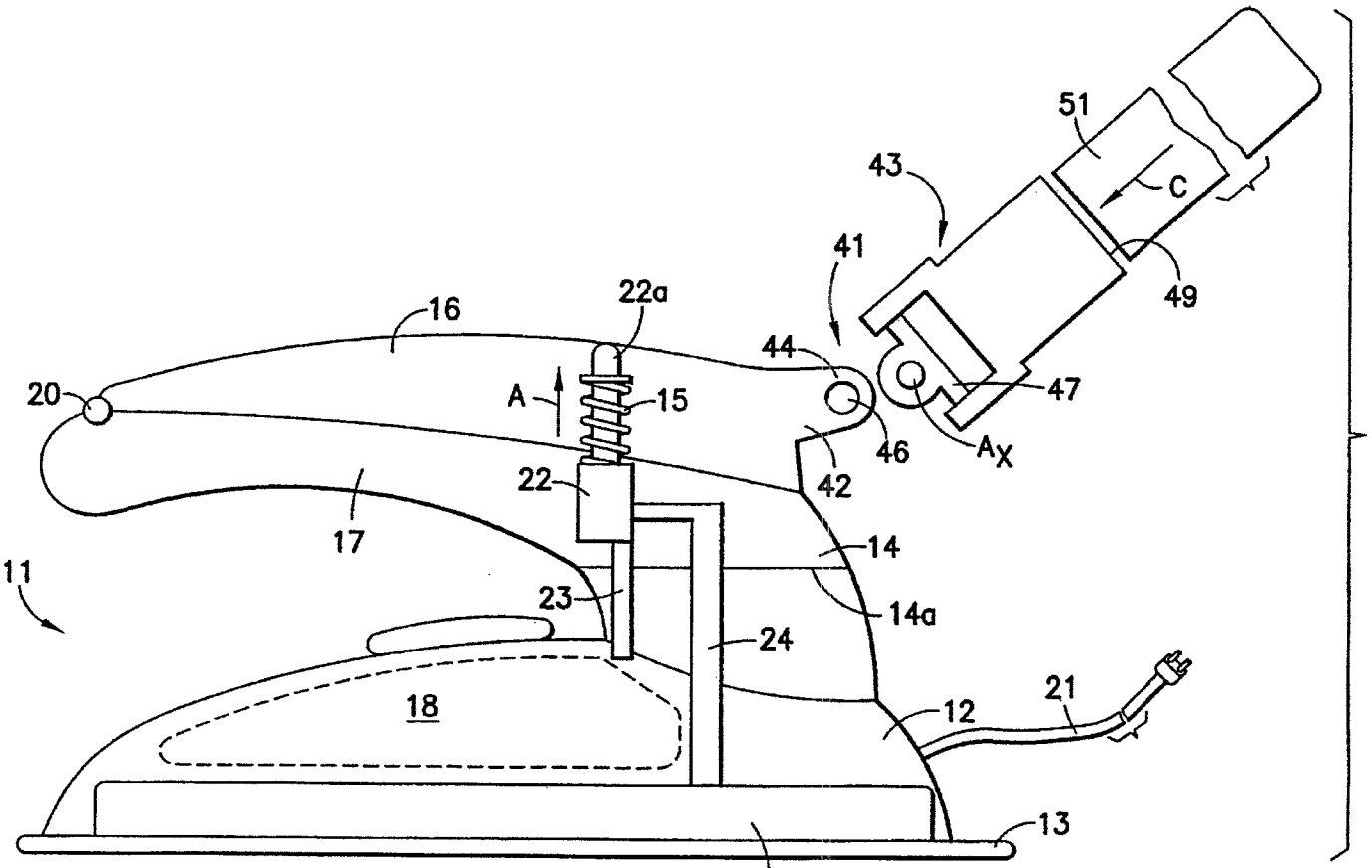
FIG. 1 is a schematic view of a steam appliance in an at rest position with a split handle and upper part contacting a mechanical pump piston constructed and arranged in accordance with the invention.

FIG. 1 is a schematic view of a steam iron 11 constructed and arranged in accordance with the invention. Iron 11 includes a housing 12 having a sole plate 13 at the bottom and an elongated handle 14 at the top. In this embodiment, handle 14 is a longitudinally split handle with an upper handle part 16 and a lower handle part 17 secured to housing 12. In this particular iron, handle 14 is designed to swivel 180° about a handle connection 14*a*.

Upper handle part 16 is connected to the front of lower handle part 17 by a hinge 20 maintained in an open position shown by an arrow A by a spring 15. Sole plate 13 includes a plurality of steam outlet openings for delivering steam to a garment or fabric to be ironed. In an alternative embodiment, the hinge can be at the opposite end so long as downward movement displaces the actuator.

Housing 12 includes internal elements similar to those in a typical steam iron, such as a water reservoir or tank 18 and a steam generator 19. Iron 11 is powered by household current by a power cord 21.

Water in reservoir 18 is fed to a mechanical pump 22 through a pump inlet hose 23 and to steam generator 19 by a pump outlet hose 24. In this embodiment, water is pumped by pump 22 by movement of a pump actuator 27*a*. It is within the scope of the invention to use an electrical or systolic pump that is activated by an actuator, such as a micro-switch or motion sensor.

Figure 2:
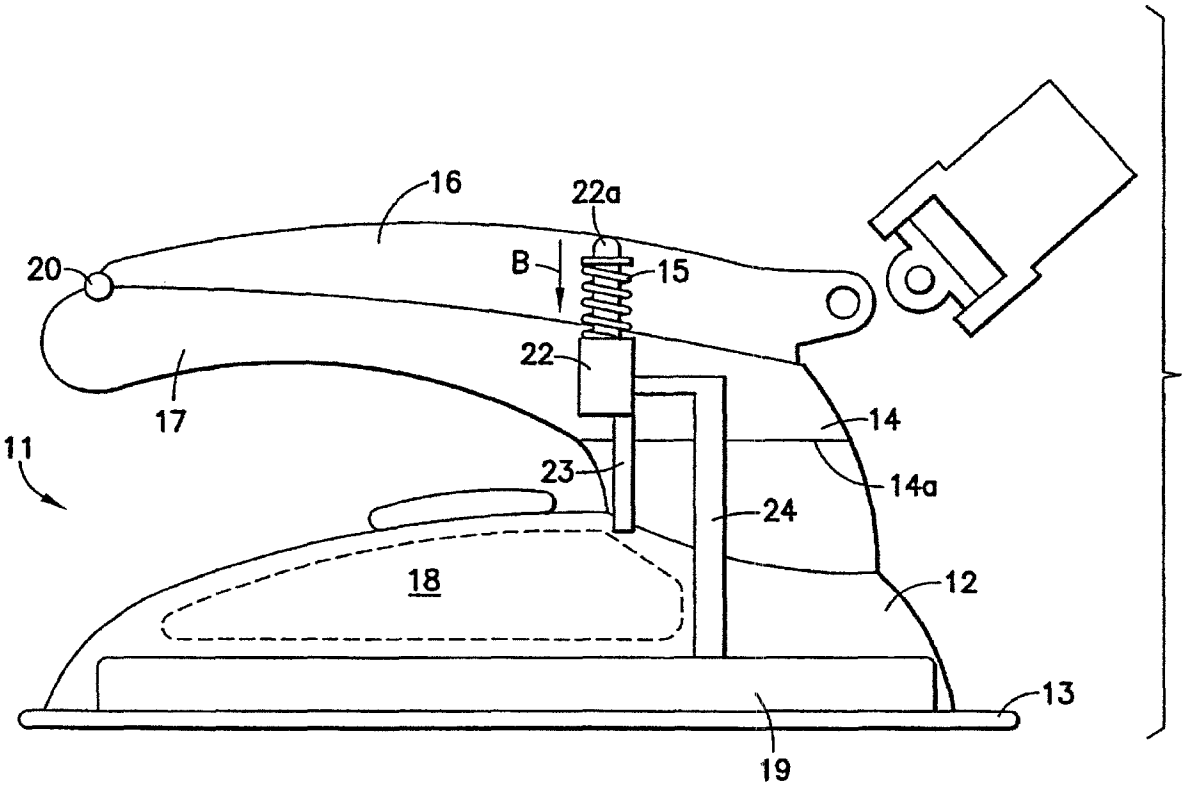
FIG. 2 is a schematic view of the steam appliance as in FIG. 1 with the upper position of the handle depressed to actuate the pump.

Once iron 11 is pushed by a user to start the ironing process, the weight of the user's hand and the force of pressure that user applies to handle upper part 16 is great enough to overcome the force of spring 15 and to force pump actuator 22*a* downward as shown by an arrow B as shown in FIG. 2. This movement draws water from reservoir 18 and pumps water to steam generator 19. In the case of an electric pump, pushing handle upper part 16 contacts a micro-switch to start water delivery to steam generator 19 by activating pump 22 causing water to be pumped to generator 18 and the steam generation process to start. Steam generator 19 is maintained hot from the moment when iron 11 is plugged into a wall outlet to reduce delay time between uses.

Once the ironing process is stopped and handle upper part 16 of iron 11 is left without any excessive weight, spring 15 returns upper handle 16 to its at rest position as shown by arrow A in FIG. 1. In the case of an electrical pump, when at rest, micro-switch is turned OFF. This interrupts water delivery into steam generator 19 and the steam generation process is stopped.

Figure 3:
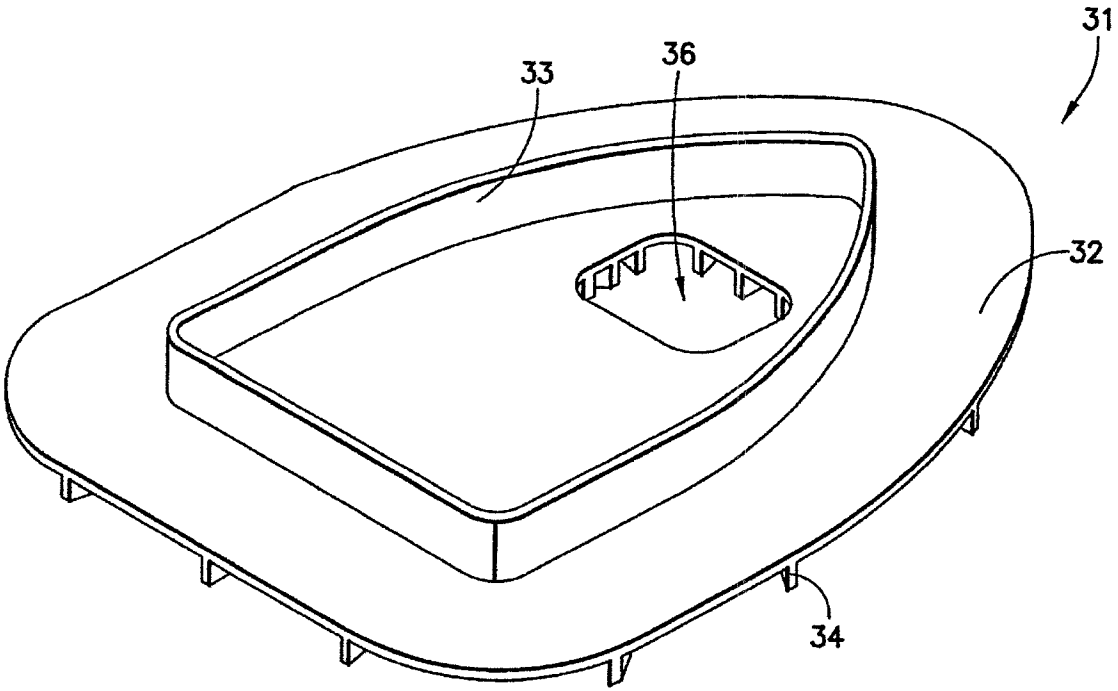
FIG. 3 is a perspective view of a towel frame for mounting on the sole plate of the iron of FIGS. 1 and 2.
Figure 4:
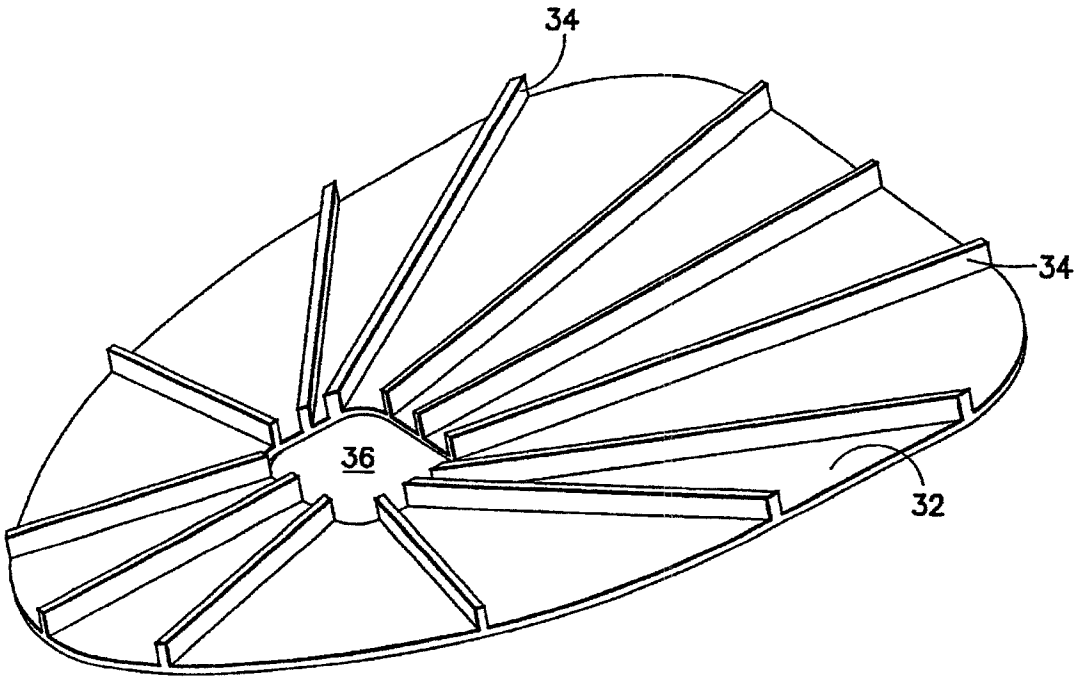
FIG. 4 is a perspective view of the base of the towel frame of FIG. 3.
Figure 5:
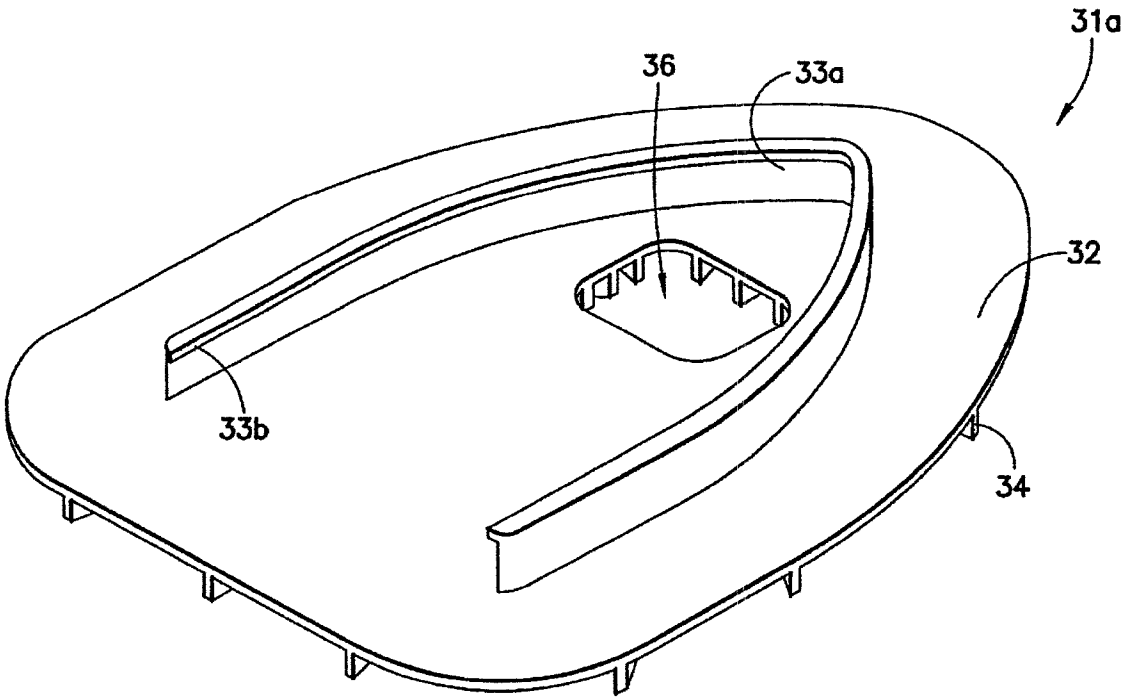
FIG. 5 is a perspective view of an alternate embodiment of the towel frame.

FIG. 3 is a perspective view of a steam frame 31 having a planar base 32 and an iron receiving frame 33 on the upper surface and a series of vertically disposed baffles 34 on the opposed lower surface. Base 32 includes an opening 36 positioned to allow steam expelled from the steam outlet openings in sole plate 13 to be fed into the space formed between baffles 34. FIG. 4 shows the arrangement of baffles 34. FIG. 5 shows another configuration of a steam frame 31*a* with an iron receiving frame 33*a* on frame base 31 having a retaining lip 33*b*.

Figure 6:
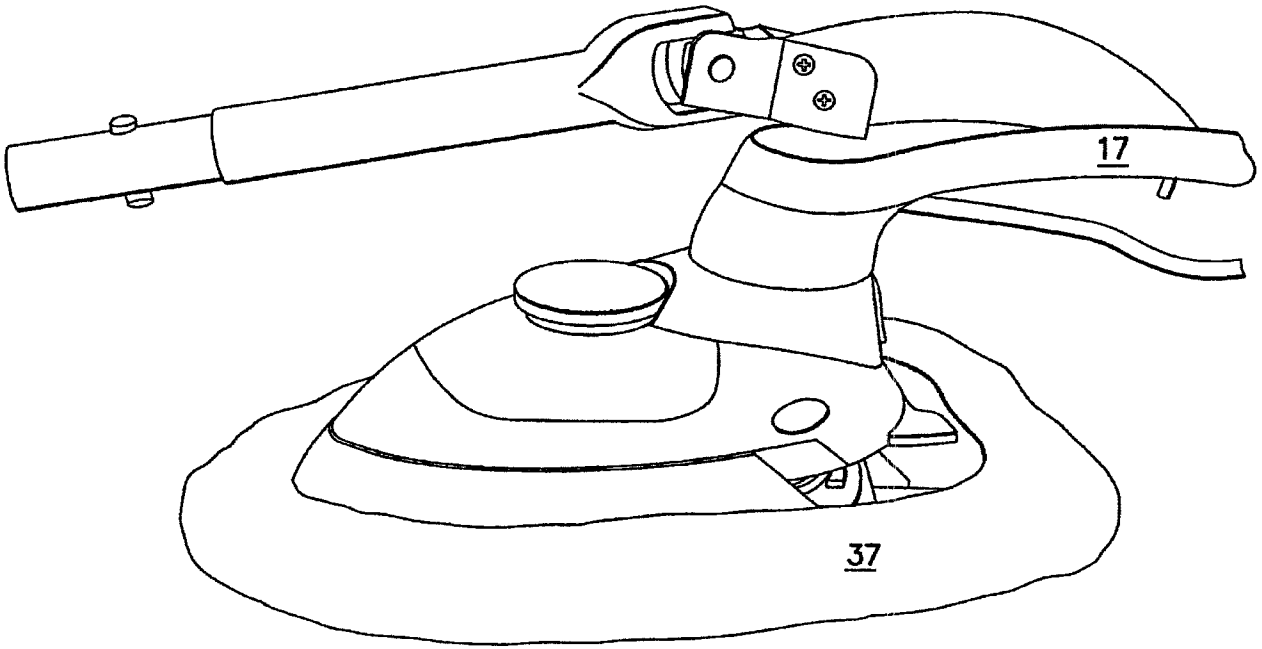
FIG. 6 is a perspective view of a steam appliance with a towel frame mounted on the sole plate for receiving a fabric steam towel.

FIG. 6 shows steam iron 11 with towel frame 37 in place secured to sole plate 13. As shown in FIG. 4, frame 31 includes a grid of baffles 34 to spread out steam generated in generator 19. The space between baffles allows for venting of steam when towel 37 is attached. Towel 37 secured to frame 31 may include upholstery glides for ease of use when cleaning upholstery and other fabrics.

Towel 37 may be secured to frame 31 in a variety of ways. For example the towel may be a fabric steam pad with fasteners on the top and cleats on the frame as described in U.S. application Ser. No. 11/769,521 (published as U.S. Application Publication No. 2008/0066789) and Ser. No. 12/044,301 (published as U.S. Application Publication No. 2009/0000051) the contents of which are incorporated herein by reference in its entirety. Alternatively, the towel may be a steam pocket as described in application U.S. Ser. No. 12/044,402 (published as U.S. Application Publication No. 2009/0223540) the contents of which is incorporated herein by reference in its entirety. When steam towel 37 is attached to towel frame 31 as shown in FIG. 6, steam appliance 11 may be used as a hand steam cleaner.

Figure 7:
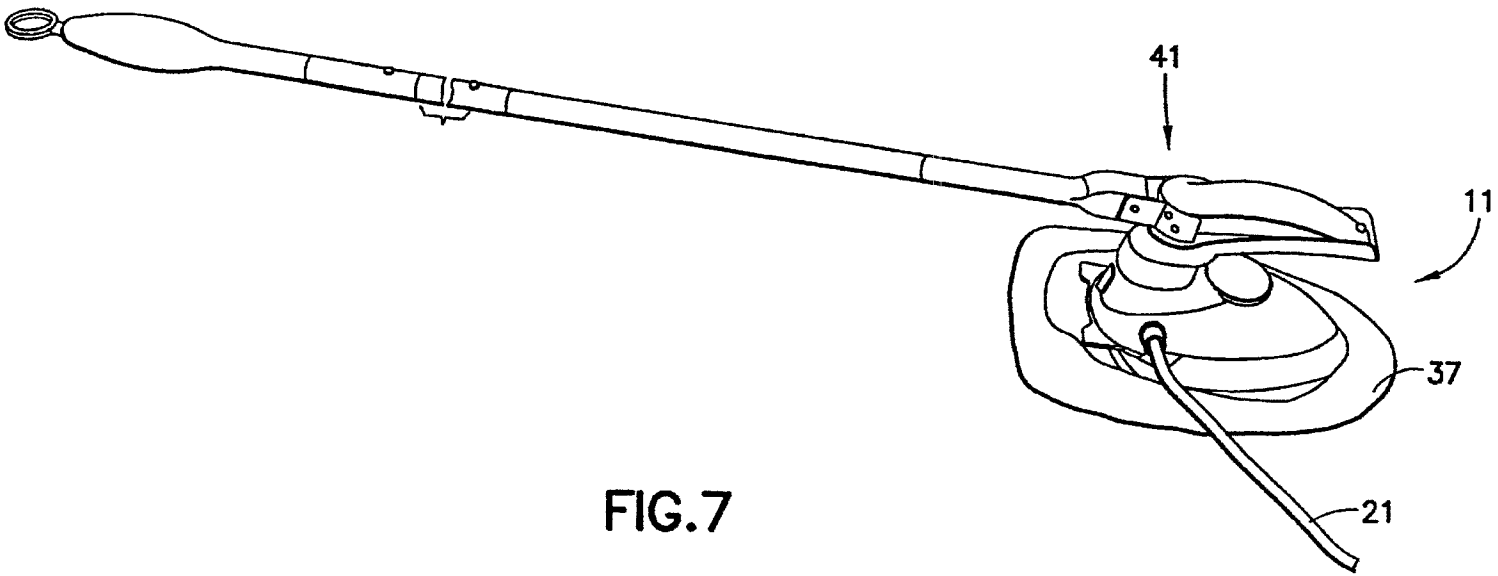
FIG. 7 is a perspective view of the steam appliance with a towel frame and towel and pole attached to the free rear end of the upper part of the handle.

Steam appliance 11 may be further modified to receive a pole 51 to reach out-of the way places and use appliance 11 as a steam mop. As shown in FIGS. 1 and 7 a pole connector 41 includes a handle adapter 42 and a pole receiving connector 43. Handle adapter 42 is formed at the free end of handle upper part 16 and includes two arms 44 with holes 46. Pole receiving connector 43 includes a handle hinge connection 47 with a pin hole 48 for mounting to handle adapter 42. When connected, handle connection 47 and handle adapter 42 function as a hinge allowing up and down pivoting. Receiving connector 43 also includes a pole receiving opening 49 for receiving pole 51 as shown in FIG. 1 by moving pole 51 in the direction of an arrow C.

FIG. 7 shows the appliance assembled as a steam mop. Connector 41 also includes a hinge 47 is at right angles to holes 46 and opening 48 to allow connector 41 to pivot left and right freely. This provides a universal joint to connector 41. Pole 51 may be one piece, telescoping or formed of separate sections to permit a use to decide the length for convenient use based on the height of the user, or location of the area to be steamed. Pole 51 may also be formed with a user friendly handle 52.

Appliance 11 also includes a switch to disable the actuator so that the appliance such as an iron, can be used dry. In the illustrated embodiment, handle 14 is a split elongated design. It is within the scope of the invention to prove an appliance with a conventional steam iron handle with a button actuator to actuate a pump that is depressed by a user pushing the appliance by hand or through a pole mounted to the handle and adapted to depress the button when pushing the pole to move the appliance.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A steam appliance, comprising:

(a) an appliance body having:

(i) at least one steam outlet opening, (ii) a housing that houses a water reservoir, (iii) a steam generator, and (iv) a pump connecting the water reservoir to the steam generator to pump water from the water reservoir to the steam generator;

(b) a handle having an upper handle part and a lower handle part, the upper handle part being connected to the lower handle part by a hinge, the handle being operatively connected to the pump, wherein rotational movement of the upper handle part about the hinge activates the pump to pump water to the steam generator, and wherein the handle is configured to swivel 180 degrees relative to the housing; and (c) a pole connector to connect a pole to the steam appliance, the pole connector being connected to the upper handle part, wherein the pole connector includes:

(i) at least a first hinge connection to allow the pole connected to the pole connector to pivot up and down; and (ii) a second hinge at 90 degrees to the first hinge to allow the pole connected to the pole connector to pivot side to side.

2. The steam appliance of claim 1, wherein the pole connector includes a universal joint.

3. The steam appliance of claim 1, further comprising a spring to bias the upper handle part away from the lower handle part.

4. A steam appliance, comprising:

(a) an appliance body having:

(i) at least one steam outlet opening, (ii) a housing that houses a water reservoir, (iii) a steam generator, and (iv) a pump connecting the water reservoir to the steam generator to pump water from the water reservoir to the steam generator;

(b) a handle having an upper handle part and a lower handle part, the upper handle part being connected to the lower handle part by a hinge, the handle being operatively connected to the pump, wherein rotational movement of the upper handle part about the hinge activates the pump to pump water to the steam generator, and wherein the handle is configured to swivel 180 degrees relative to the housing; and (c) a pole connector to connect a pole to the steam appliance, the pole connector being connected to the upper handle part, wherein the pole connector includes a handle adapter and a pole receiving connector, the handle adapter being formed at a free end of the upper handle part.

5. The steam appliance of claim 4, wherein the pole connector includes a universal joint.

6. The steam appliance of claim 4, further comprising a spring to bias the upper handle part away from the lower handle part.

* * * * *